US006405505B1

(12) United States Patent
Alberti

(10) Patent No.: US 6,405,505 B1
(45) Date of Patent: Jun. 18, 2002

(54) MODULAR INTERLOCK WALL FORM

(76) Inventor: Carlo Alberti, 210 Hillside Ave., Springfield, NJ (US) 07081

( * ) Notice: Subject to any disclaimer, the term of this patent is extended or adjusted under 35 U.S.C. 154(b) by 0 days.

(21) Appl. No.: 09/586,353

(22) Filed: Jun. 2, 2000

(51) Int. Cl.[7] ..... E04B 2/42

(52) U.S. Cl. ..... 52/562; 52/561; 52/564; 52/425; 52/426; 52/466; 52/422

(58) Field of Search ..... 52/425, 426, 562, 52/564, 466, 467, 440, 442, 223.6, 223.7, 422

(56) References Cited

U.S. PATENT DOCUMENTS

| | | | | | |
|---|---|---|---|---|---|
| 851,991 | A | * | 4/1907 | Molloy | 52/223.7 |
| 1,852,049 | A | * | 4/1932 | Graef | 52/223.7 |
| 2,029,082 | A | | 1/1936 | Odam | |
| 2,676,482 | A | * | 4/1954 | Wilson | 52/426 |
| 2,851,875 | A | * | 9/1958 | Astorga | 52/426 |
| 3,292,331 | A | | 12/1966 | Sams | |
| 3,344,572 | A | | 10/1967 | Sell | |
| 3,827,205 | A | * | 8/1974 | Barbera | 52/426 |
| 4,034,529 | A | * | 7/1977 | Lampus | 52/426 |
| 4,091,585 | A | * | 5/1978 | Rudichuk | 52/274 |
| 4,433,520 | A | * | 2/1984 | Maschhoff | 52/275 |
| 4,604,843 | A | * | 8/1986 | Ott et al. | 52/426 |
| 4,694,624 | A | * | 9/1987 | Juhas | 52/228 |
| 4,835,928 | A | * | 6/1989 | Scott | 52/426 |
| 4,884,382 | A | | 12/1989 | Horobin | |
| 4,888,931 | A | * | 12/1989 | Meilleur | 52/426 |
| 4,944,664 | A | | 7/1990 | Allred | |
| 5,119,610 | A | * | 6/1992 | Birkeland et al. | 52/241 |
| 5,259,161 | A | * | 11/1993 | Carter | 52/307 |
| 5,566,518 | A | * | 10/1996 | Martin et al. | 52/426 |
| 5,570,552 | A | * | 11/1996 | Nehring | 52/426 |
| 5,625,989 | A | | 5/1997 | Brubaker et al. | |
| 6,119,418 | A | * | 9/2000 | Johnson | 52/223.7 |

* cited by examiner

*Primary Examiner*—Carl D. Friedman
*Assistant Examiner*—Phi Dieu Tran A

(57) ABSTRACT

A modular interlock wall form for providing a sturdy wall structure that is easily assembled and disassembled. The modular interlock wall form includes a base frame for resting on a surface, and which includes a pair of elongate base rails extending in the longitudinal direction of the base frame. The base rails are laterally spaced, and at least one lateral member extends laterally across the base rails. The lateral member has a fascia support portion extending substantially perpendicular to an axis of a central portion of the lateral member, A face panel is provided for forming a face of the modular interlock wall form. The face panel has opposite surfaces and a perimeter edge. The perimeter edge comprises opposite end edges and opposite first and second edges. The first edge is adapted for being oriented downwardly and the second edge is adapted for being oriented upwardly. The second edge has a tongue extending along the length of the second edge with at least one pocket recessed in the tongue. The first edge has a groove extending along the length of the first edge, and is also adapted to receive one of the base rails of the base frame and is adapted to receive the tongue of the first edge. The end edges also have grooves formed therein. A linking frame is provided for linking spaced tiers of face panels together. The linking frame comprises a pair of linking members extending in the longitudinal direction of the linking frame, and at least one spanning member extending laterally across the linking members. The spanning member is coupled to each of the linking members.

16 Claims, 4 Drawing Sheets

MODULAR INTERLOCK WALL FORM

BACKGROUND OF THE INVENTION

1. Field of the Invention

The present invention relates to wall building systems and more particularly pertains to a new modular interlock wall form for providing a sturdy wall structure that is easily assembled and used for forming a concrete wall.

2. Description of the Prior Art

The use of wall building systems is known in the prior art. More specifically, wall building systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,625,989; U.S. Pat. No. 4,944,664; U.S. Pat. No. 4,884,382; U.S. Pat. No. 3,292,331; U.S. Pat. No. 3,344,572; and U.S. Pat. No. 2,029,082.

While these devices fulfill their respective, particular objectives and requirements, the aforementioned patents do not disclose a new modular interlock wall form. The inventive device includes a base frame for resting on a surface, and includes a pair of elongate base rails extending in the longitudinal direction of the base frame. The base rails are laterally spaced, and at least one lateral member extends laterally across the base rails. The lateral member has a fascia support portion extending substantially perpendicular to an axis of a central portion of the lateral member. A face panel is provided for forming a face of the modular interlock wall form. The face panel has opposite surfaces and a perimeter edge. The perimeter edge comprises opposite end edges and opposite first and second edges. The first edge is adapted for being oriented downwardly and the second edge is adapted for being oriented upwardly. The second edge has a tongue extending along the length of the second edge with at least one pocket recessed in the tongue. The first edge has a groove extending along the length of the first edge, and is adapted to receive one of the base rails of the base frame and is also adapted to receive the tongue of the first edge. The end edges also have grooves formed therein. A linking frame is provided for linking spaced tiers of face panels together. The linking frame comprises a pair of linking members extending in the longitudinal direction of the linking frame, and also at least one spanning member extending laterally across and coupled to the linking members.

In these respects, the modular interlock wall form according to the present invention substantially departs from the conventional concepts and designs of the prior art, and in so doing provides an apparatus primarily developed for the purpose of for providing a study wall structure that is easily assembled and disassembled.

SUMMARY OF THE INVENTION

In view of the foregoing disadvantages inherent in the known types of wall building systems now present in the prior art, the present invention provides a new modular interlock wall form construction wherein the same can be utilized for providing a study wall structure that is easily assembled and disassembled.

The general purpose of the present invention, which will be described subsequently in greater detail, is to provide a new modular interlock wall form apparatus and method which has many of the advantages of the wall building systems mentioned heretofore and many novel features that result in a new modular interlock wall form which is not anticipated, rendered obvious, suggested, or even implied by any of the prior art wall building systems, either alone or in any combination thereof.

To attain this, the present invention generally comprises a base frame for resting on a surface, and includes a pair of elongate base rails extending in the longitudinal direction of the base frame. The base rails are laterally spaced, and at least one lateral member extends laterally across the base rails. The lateral member has a fascia support portion extending substantially perpendicular to an axis of a central portion of the lateral member. A face panel is provided for forming a face of the modular interlock wall form. The face panel has opposite surfaces and a perimeter edge. The perimeter edge comprises opposite end edges and opposite first and second edges. The first edge is adapted for being oriented downwardly and the second edge is adapted for being oriented upwardly. The second edge has a tongue extending along the length of the second edge with at least one pocket recessed in the tongue. The first edge has a groove extending along the length of the first edge, and is adapted to receive one of the base rails of the base frame and is also adapted to receive the tongue of the first edge. The end edges also have grooves formed therein. A linking frame is provided for linking spaced tiers of face panels together. The linking frame comprises a pair of linking members extending in the longitudinal direction of the linking frame, and also at least one spanning member extending laterally across and coupled to the linking members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new modular interlock wall form apparatus and method which has many of the advantages of the wall building systems mentioned heretofore and many novel features that result in a new modular interlock wall form which is not anticipated, rendered obvious, suggested, or even implied by any of the prior art wall building systems, either alone or in any combination thereof.

It is another object of the present invention to provide a new modular interlock wall form which may be easily and efficiently manufactured and marketed.

It is a further object of the present invention to provide a new modular interlock wall form which is of a durable and reliable construction.

An even further object of the present invention is to provide a new modular interlock wall form which is susceptible of a low cost of manufacture with regard to both materials and labor, and which accordingly is then susceptible of low prices of sale to the consuming public, thereby making such modular interlock wall form economically available to the buying public.

Still yet another object of the present invention is to provide a new modular interlock wall form which provides in the apparatuses and methods of the prior art some of the advantages thereof, while simultaneously overcoming some of the disadvantages normally associated therewith.

Still another object of the present invention is to provide a new modular interlock wall form for providing a study wall structure that is easily assembled and disassembled.

Yet another object of the present invention is to provide a new modular interlock wall form which includes a base frame for resting on a surface, and includes a pair of elongate base rails extending in the longitudinal direction of the base frame. The base rails are laterally spaced, and at least one lateral member extends laterally across the base rails. The lateral member has a fascia support portion extending substantially perpendicular to an axis of a central portion of the lateral member. A face panel is provided for forming a face of the modular interlock wall form. The face panel has opposite surfaces and a perimeter edge. The perimeter edge comprises opposite end edges and opposite first and second edges. The first edge is adapted for being oriented downwardly and the second edge is adapted for being oriented upwardly. The second edge has a tongue extending along the length of the second edge with at least one pocket recessed in the tongue. The first edge has a groove extending along the length of the first edge, and is adapted to receive one of the base rails of the base frame and is also adapted to receive the tongue of the first edge. The end edges also have grooves formed therein. A linking frame is provided for linking spaced tiers of face panels together. The linking frame comprises a pair of linking members extending in the longitudinal direction of the linking frame, and also at least one spanning member extending laterally across and coupled to the linking members.

Still yet another object of the present invention is to provide a new modular interlock wall form that allows for making solid concrete walls with an integral frame to replace concrete block walls.

Even still another object of the present invention is to provide a new modular interlock wall form that will allow individuals who are not professionals to successfully form up and pour concrete walls without requiring the customary bulky forms that must be stripped from the concrete wall after use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
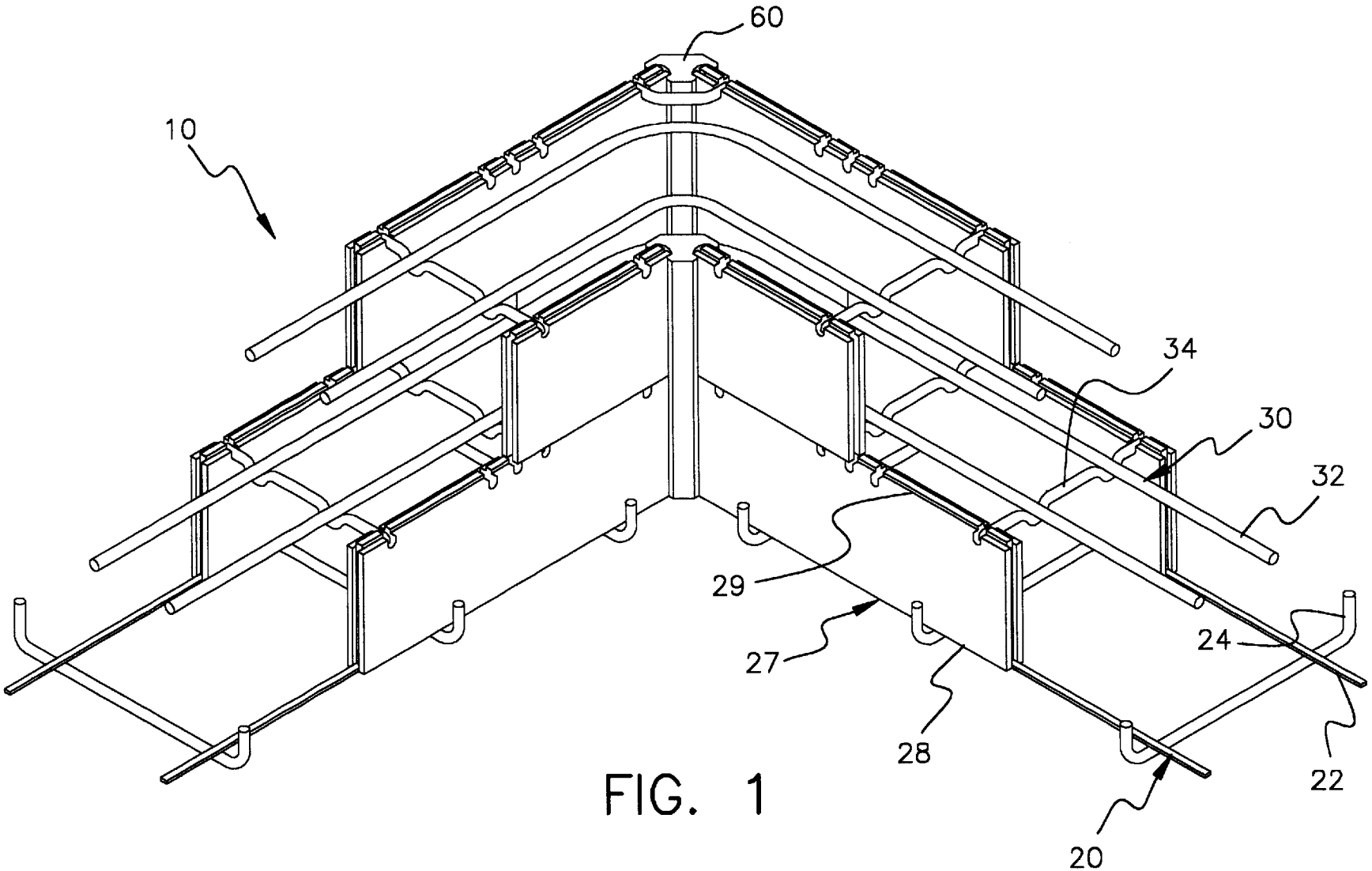
FIG. 1 is a schematic view of a new modular interlock wall form according to the present invention.
Figure 2:
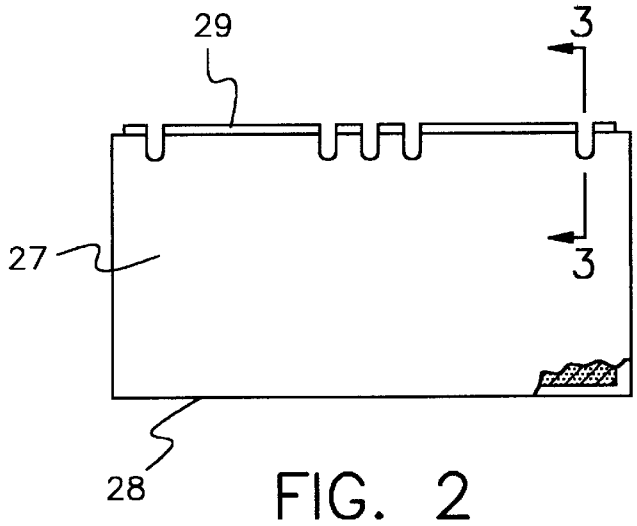
FIG. 2 is a schematic view of the face panel of the present invention.
Figure 3:
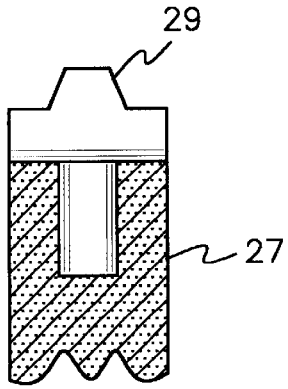
FIG. 3 is a detail schematic view taken along line 3 of FIG. 2 of the present invention.
Figure 4:
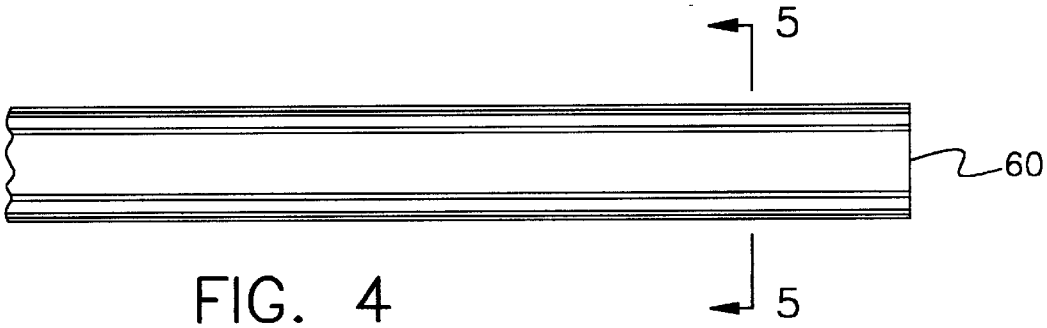
FIG. 4 is a detail schematic view of the corner forming member of the present invention.
Figure 6:
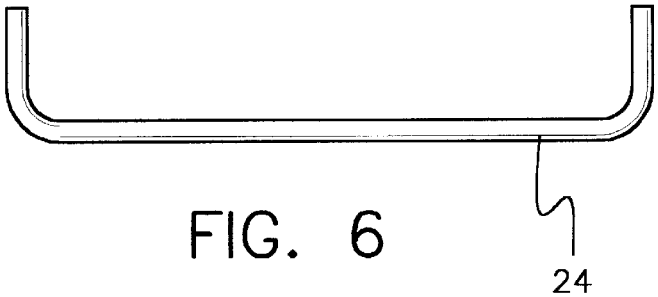
FIG. 6 is a detail schematic view of the lateral members of the present invention.
Figure 5:
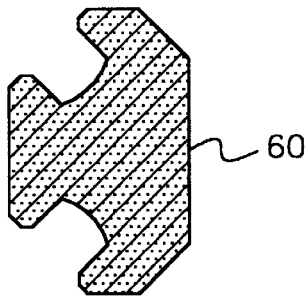
FIG. 5 is a detail schematic view taken along line 5 of FIG. 4 of the present invention.
Figure 7:
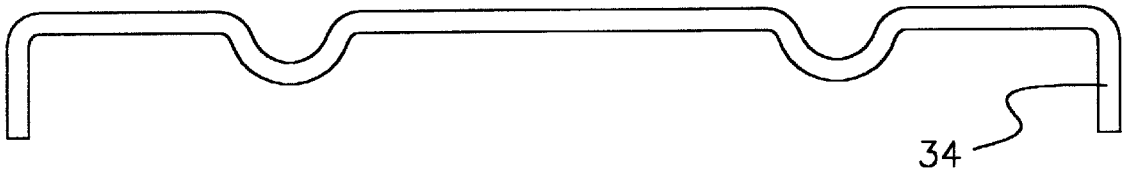
FIG. 7 is a detail schematic view of the spanning member of the linking frame of the present invention.
Figure 8:
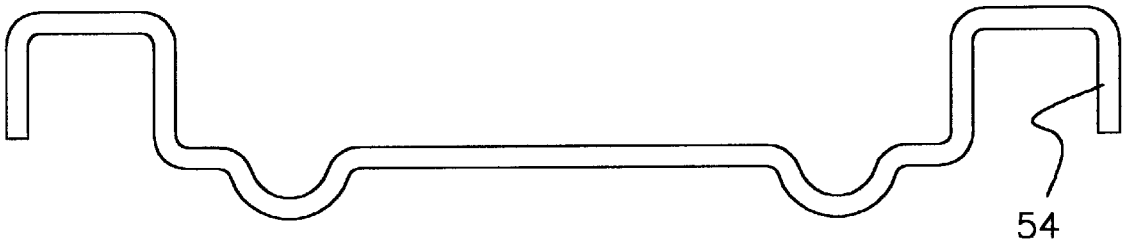
FIG. 8 is a detail schematic view of the spanning member of the supplemental linking frame of the present invention.
Figure 9:
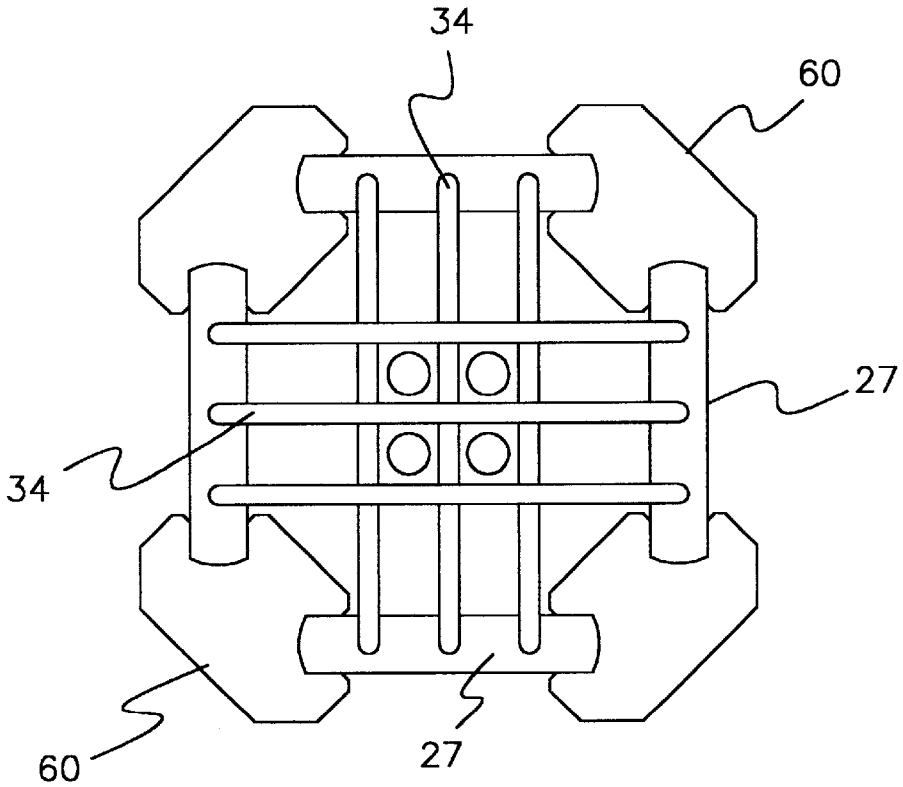
FIG. 9 is a top schematic view of a completed section with four sides of the present invention.
Figure 10:
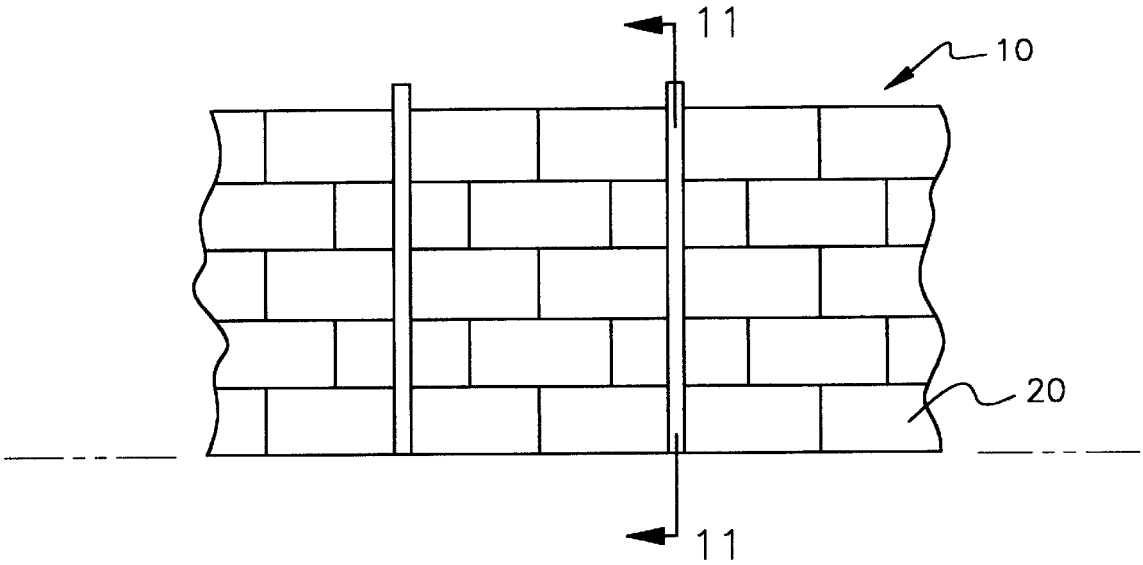
FIG. 10 is a front schematic view of a completed section of the present invention.
Figure 11:
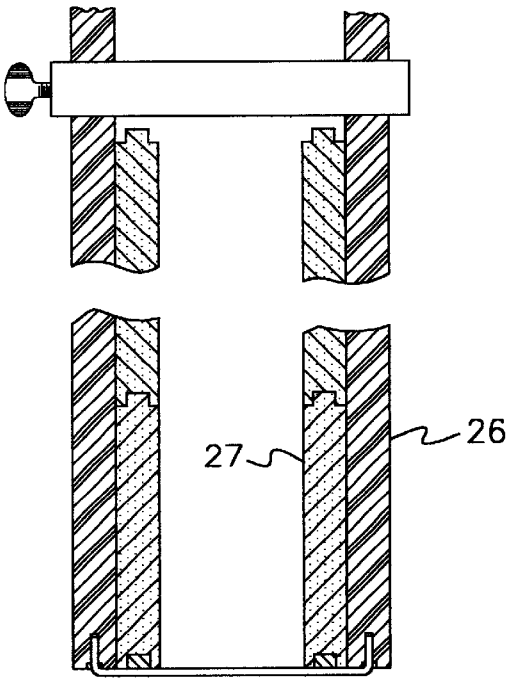
FIG. 11 is a cross-sectional schematic view taken along line 11 of FIG. 10 of the present invention.
Figure 12:
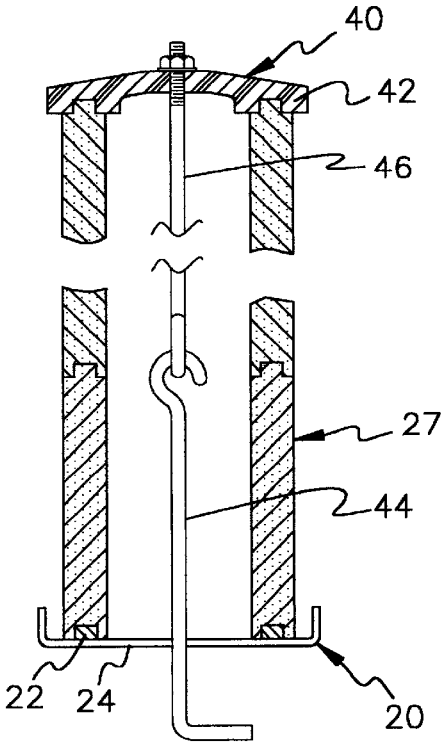
FIG. 12 is a cross-sectional schematic view of the cap assembly of the present invention.

With reference now to the drawings, and in particular to FIGS. 1 through 12 thereof, a new modular interlock wall form embodying the principles and concepts of the present invention and generally designated by the reference numeral 10 will be described.

As best illustrated in FIGS. 1 through 12, the modular interlock wall form 10 generally comprises a kit for forming a modular interlock wall form for a poured concrete wall that is easily assembled and disassembled, or may be left in place as a part of the poured concrete wall. The kit may include a base frame 20, face panels 28, a linking frame 30, a corner forming members 60, fascia panel 26, a cap assembly 40, and a supplemental linking frame 50.

The base frame 20 is designed to rest on a surface. The base frame 20 is elongated and has opposite ends. The base frame 20 is designed to be positioned in an end-to-end orientation with other base frames 20. The base frame 20 comprises a pair of elongated base rails 22 and a plurality of lateral members 24. The pair of elongated base rails 22 extend in the longitudinal direction of the base frame 20. The base rails 22 are laterally spaced from each other.

The plurality of lateral members 24 extend laterally across the base rails 22. The lateral members 24 are substantially uniformly longitudinally spaced along the length of the base rails 22 of the base frame 20. Each of the lateral members 24 has opposite ends. The ends of the lateral members 24 have a fascia support portion extending perpendicular to an axis of a central portion of the lateral members 24. In one embodiment, the fascia support portion of each of the lateral members 24 is laterally spaced from the base rail 22.

The face panel 27 forms a face of the modular interlock wall form. The face panel 27 has opposite surfaces and a perimeter edge. The perimeter edge comprises opposite end edges and opposite first 28 and second edges 29. The face panel 27 is substantially rectangular with relatively longer first 28 and second edges 29 and relatively shorter end edges. The first edge 28 is designed to be oriented downwardly, and the second edge 29 is designed to be oriented upwardly. The second edge 29 has a tongue extending along the length of the second edge 29. The first edge 28 has a groove extending along the length of the first edge. The groove in the first edge 28 is designed to receive one of the base rails 22 of the base frame 20 and is designed to receive the tongue of the second edge 29. The end edges have grooves.

The linking frame 30 is used for linking spaced tiers of face panels together. The linking frame 30 is elongated and has opposite ends. The linking frame 30 is designed for positioning in an end-to-end orientation with other linking frames 30. The linking frame 30 comprises a pair of elongated longitudinal linking members 32 and a plurality of spanning members 34.

The pair of elongated longitudinal linking members 32 extend in the longitudinal direction of the linking frame 30. The linking members 32 are laterally spaced.

The plurality of spanning members 34 extend laterally across the linking members 32. The spanning members 34 are substantially uniformly longitudinally spaced along the length of the linking members 32 of the linking frame 30. Each of the spanning members 34 has opposite ends. The spanning members 34 are coupled to each of the linking members 32 at laterally spaced locations on the spanning member 34. The spanning members 34 each are generally elongated with opposite end portions and a central portion. The end portions are oriented perpendicular to the central portion for being inserted into pockets formed in the groove of the second edge 29 of the face panel 27. The central portion comprises a pair of arcuate semicircular portions linked by a substantially straight portion. The linking member 32 is mounted on one of the arcuate semicircular portions of the spanning member 34.

The corner forming member 60 is used for forming a corner in a modular interlock wall form. The corner forming member 60 is elongated with opposite ends. The corner forming member 60 has a pair of grooves for receiving end edges of face panels 27. The pair of grooves has substantially parallel lengths. The grooves each have a depth direction extending perpendicular to the length of the groove. The depth direction of one of the grooves is oriented substantially perpendicular to the depth direction of the other of the grooves. A face panel 27 may have an end edge inserted into one of the grooves of the corner forming member, and would thus be oriented perpendicular to a face panel 27 having and end edge inserted into the other of the grooves.

The fascia panel 26 is positioned adjacent to a surface of the face panel 27. The fascia panel 26 has a recess for receiving the fascia support portion of one of the lateral members 24 such that the fascia panel 26 is held in a position adjacent to one of the surface of the face panel 27 mounted on the base rail 22.

The cap assembly 40 is provided for capping a modular interlock wall form, and may comprise a cap panel 42, an anchor 44, and a cap panel securing rod 46.

The cap panel 42 is elongated and has opposite ends. The cap panel 42 has a pair of laterally spaced parallel grooves extending between the ends of the cap panel 42 for receiving the tongue of the second edge 29 of a pair of laterally spaced face panels 27. The cap panel 42 has an aperture positioned between the grooves.

The anchor 44 has an L-shaped portion and a hook portion. The L-shaped portion is designed for embedding in the surface with the hook portion extending upward from the surface between spaced face panels 27 of the modular interlocking wall form.

The cap panel securing rod 46 has a hook portion and a substantially straight portion. The hook portion is designed for linking with the hook portion of the anchor 44. The substantially straight portion is designed for passing through the aperture in the cap panel 42. The cap panel securing rod 46 has a threaded end portion. The threaded end portion extends through the aperture such that a nut may be threaded onto the securing rod 46 for pulling the cap panel 42 toward the surface in which the anchor 44 is embedded.

The supplemental linking frame 50 is used for linking spaced tiers of face panels 27 together at an upper portion of an modular interlocking wall below a cap panel 42. The supplemental linking frame 50 is elongated and has opposite ends. The linking frame 50 is designed for positioning in an end-to-end orientation with other linking frames 50.

The supplemental linking frame 50 comprises a pair of elongated longitudinal linking members 52 and a plurality of spanning members 54. The pair of elongated longitudinal linking members 52 extend in the longitudinal direction of the linking frame 50. The linking members 52 are laterally spaced.

The plurality of spanning members 54 extend laterally across the linking members 52. The spanning members 54 are substantially uniformly longitudinally spaced along the length of the linking members 52 of the linking frame 50. Each of the spanning members 54 has opposite ends. The linking members 52 are coupled to each of the spanning members 54 at laterally spaced locations on the spanning member 54. The spanning members 54 each are generally elongated with opposite end portions and a central portion. The end portions are substantially U-shaped with an end oriented perpendicular to the central portion for being inserted into pockets formed in the groove of the second edge 29 of the face panel 27. The central portion has a pair of arcuate semicircular portions linked by a substantially straight portion. The linking member 52 is mounted on one of the arcuate semicircular portions of the spanning member 54.

Optionally, the second edge 29 of the face panel 27 may have a lateral slot oriented substantially perpendicular to the groove in the second edge 29. The lateral slot is designed to receive a portion of the length of one of the spanning members 54.

In another aspect of the invention, the kit includes a plurality of face panels 27, at least one of the plurality of face panels 27 has a first length 28 and at least one of the plurality of face panels 27 has a second length 29. The second length 29 is approximately twice the first length 28.

In use, the anchors of the cap assembly are spaced along the length of the span for the wall. The anchors are spaced in a roughly uniform manner longitudinally along the span with the L-shaped portion embedded into the surface and the hook portion extending upwardly above the surface. The lateral members of the base frame are positioned along the span of the wall running laterally with respect to the span. The lateral members are positioned so that the portion of the anchors extending from the surface are roughly laterally centered along the span. The elongated base rails are positioned so that the lateral members extend longitudinally along the span. This completes the base frame. The face panels are positioned with the first edge on the base rails. Spanning members of the linking frame are positioned laterally along the span, and located in notches provided in the face panels. The elongated longitudinal linking members are positioned on the spanning members of the linking frame and located in the arcuate semicircular portions of the spanning members. If another course is desired to increase the height of the wall, then additional face panels are located on top of the first course of face panels. The first edge of the second course of face panels is positioned on the second edge of the first course of panels. The securing of the second course of face panels is completed as described above. This process is repeated until the desired height is obtained. When the desired height has been reached, the cap panel securing rods are connected to the anchors. The cap panel is then placed over the cap panel securing rod, with the threaded end of the cap panel securing rod extending through an aperture in the cap panel. A nut is then applied to and tightened on each of the cap panel securing rods, thereby securing the cap panel and completing the cap assembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A kit for forming a modular interlock wall form, the kit comprising:

a base frame for resting on a surface, the base frame comprising:

a pair of elongate base rails extending in the longitudinal direction of the base frame, the base rails being laterally spaced; and at least one lateral member extending laterally across the base rails and having a fascia support portion extending perpendicular to an axis of a central portion of the lateral members;

a face panel for forming a face of the modular interlock wall form, the face panel having opposite surfaces and a perimeter edge, the perimeter edge comprising opposite end edges and opposite first and second edges, the first edge being adapted for oriented downwardly and the second edge being adapted for orienting upwardly, the second edge having a tongue extending along the length of the second edge with at least one pocket recessed in the tongue, the first edge having a groove extending along the length of the first edge, the groove in the first edge being adapted to receive one of the base rails of the base frame and being adapted to receive the tongue of the second edge, the end edges having grooves therein; and a linking frame for linking spaced tiers of face panels together, the linking frame comprising:

a pair of linking members extending in the longitudinal direction of the linking frame; and at least one spanning member extending laterally across the linking members, the spanning member being coupled to each of the linking members;

a fascia panel for positioning adjacent to one of the opposite surfaces of the face panel, the fascia support portion of the at least one lateral member of the base frame being laterally spaced from the base rail of the base frame for supporting the fascia panel at a position laterally outward from the face panel when the face panel is mounted on the base rail, the fascia panel having a recess for receiving the fascia support portion of the at least one lateral member such that the fascia panel is held in a position adjacent to the one surface of the face panel when the face panel is mounted on the base rail.

2. A kit for forming a modular interlock wall form as set forth in claim 1 and additionally comprising a corner forming member for forming a corner in a modular interlock wall form, the corner forming member having a pair of grooves therein for receiving the end edges of the face panels.

3. A kit for forming a modular interlock wall form as set forth in claim 2 wherein the grooves of the corner forming member each have a depth direction extending perpendicular to the length of the groove, the depth direction of one of the grooves being oriented substantially perpendicular to the depth direction of the other of the grooves such that a face panel having an end edge inserted into one of the grooves is oriented perpendicular to a face panel having an end edge inserted into the other of the grooves.

4. A kit for forming a modular interlock wall form as set forth in claim 1 wherein the base frame is elongate and has opposite ends, the base frame being adapted for positioning in an end-to-end orientation with other base frames, and wherein the lateral members are substantially uniformly longitudinally spaced along the length of the base rails of the base frame, each of the lateral members having opposite ends.

5. A kit for forming a modular interlock wall form as set forth in claim 1 wherein the linking frame is elongate and has opposite ends, the linking frame being adapted for positioning in an end-to-end orientation with other linking frames, wherein the spanning members are substantially uniformly longitudinally spaced along the length of the linking members of the linking frame.

6. A kit for forming a modular interlock wall form as set forth in claim 1 wherein each of the spanning members has opposite ends, the spanning members being each generally elongate with opposite end portions and a central portion, the end portions being oriented perpendicular to the central portion for being inserted into the pockets formed in the tongue of the second edge of the face panel, the central portion comprising a pair of arcuate semicircular portions linked by a substantially straight portion, the linking member being mounted on one of the arcuate semicircular portions of the spanning member.

7. A kit for forming a modular interlock wall form as set forth in claim 1 including a plurality of face panels, at least one of the plurality of face panels having a first length and at least one of the plurality of face panels having a second length, the second length being approximately twice the first length.

8. A kit for forming a modular interlock wall form as set forth in claim 1 and additionally comprising a cap assembly for capping a modular interlock wall form, the cap assembly comprising:

a cap panel having a pair of laterally spaced parallel grooves extending between the ends of the cap panel for receiving the tongue of the second edge of a pair of laterally spaced face panels, the cap panel having an aperture therethrough between the grooves;

an anchor having an L-shaped portion and a hook portion; and a cap panel securing rod having a hook portion and a substantially straight portion, the hook portion being adapted for linking with the hook portion of the anchor, the substantially straight portion being adapted for passing through the aperture in the cap panel.

9. A kit for forming a modular interlock wall form as set forth in claim 8 wherein the L-shaped portion of the anchor is adapted for embedding in one of the opposite surfaces of the face panel with the hook portion extending upward from the surface between spaced face panels of the modular interlocking wall.

10. A kit for forming a modular interlock wall form as set forth in claim 8 wherein the cap panel securing rod has a threaded end portion for extending through the aperture such that a nut may be threaded onto the securing rod for pulling the cap panel toward the surface in which the anchor is embedded.

11. A kit for forming a modular interlock wall form as set forth in claim 1 and additionally comprising a supplemental linking frame for linking spaced tiers of face panels together at an upper portion of an modular interlocking wall below a cap panel, the supplemental linking frame comprising:

a pair linking members extending in the longitudinal direction of the linking frame; and a plurality of spanning members extending laterally across the linking members, the linking members being coupled to each of the spanning members.

12. A kit for forming a modular interlock wall form as set forth in claim 11 wherein the supplemental linking frame is elongate and has opposite ends, the linking frame being adapted for positioning in an end-to-end orientation with other base frames.

13. A kit for forming a modular interlock wall form as set forth in claim 1 wherein the spanning members are each generally elongate with opposite end portions and a central portion, and wherein the end portions of the spanning members are substantially U-shaped with an end oriented perpendicular to the central portion for being inserted into the pockets formed in the tongue of the second edge of the face panel.

14. A kit for forming a modular interlock wall form as set forth in claim 1 wherein the spanning members are each generally elongate with opposite end portions and a central portion, and wherein the central portion of the spanning members has a pair of arcuate semicircular portions linked by a substantially straight portion, the linking member being mounted on one of the arcuate semicircular portions of the spanning member.

15. A kit for forming a modular interlock wall form as set forth in claim 1 wherein the second edge of the face panel has a lateral slot oriented substantially perpendicular to the tongue in the second edge, the lateral slot being adapted to receive a portion of the length of one of the spanning members.

16. A kit for forming a modular interlock wall form for forming a wall that is easily assembled and disassembled, the kit comprising:

a base frame for resting on a surface, the base frame being elongate and having opposite ends, the base frame being adapted for positioning in an end-to-end orientation with other base frames, the base frame comprising:

a pair of elongate base rails extending in the longitudinal direction of the base frame, the base rails being laterally spaced;

a plurality of lateral members extending laterally across the base rails, the lateral members being substantially uniformly longitudinally spaced along the length of the base rails of the base frame, each of the lateral members having opposite ends, the ends of the lateral members having a fascia support portion extending perpendicular to an axis of a central portion of the lateral members, wherein the fascia support portion of each of the lateral members is laterally spaced from the base rail;

a face panel for forming a face of the modular interlock wall form, the face panel having opposite surfaces and a perimeter edge, the perimeter edge comprising opposite end edges and opposite first and second edges, the face panel being substantially rectangular with relatively longer first and second edges and relatively shorter end edges, the first edge being adapted for oriented downwardly and the second edge being adapted for orienting upwardly, the second edge having a tongue extending along the length of the second edge, the first edge having a groove extending along the length of the first edge, the groove in the first edge being adapted to receive one of the base rails of the base frame and being adapted to receive the tongue of the second edge, the end edges having grooves therein;

a linking frame for linking spaced tiers of face panels together, the linking frame being elongate and having opposite ends, the linking frame being adapted for positioning in an end-to-end orientation with other base frames the linking frame comprising:

a pair of elongate longitudinal linking members extending in the longitudinal direction of the linking frame, the linking members being laterally spaced, a plurality of spanning members extending laterally across the linking members, the spanning members being substantially uniformly longitudinally spaced along the length of the linking members of the linking frame, each of the spanning members having opposite ends, the spanning members being coupled to each of the linking members at laterally spaced locations on the spanning member, the spanning members each being generally elongate with opposite end portions and a central portion, the end portions being oriented perpendicular to the central portion for being inserted into pockets formed in the groove of the second edge of the face panel, the central portion comprising a pair of arcuate semicircular portions linked by a substantially straight portion, the linking member being mounted on one of the arcuate semicircular portions of the spanning member;

a corner forming member for forming a corner in a modular interlock wall form, the corner forming member being elongate with opposite ends, the corner forming member having pair of grooves therein for receiving end edges of face panels, the pair of grooves having substantially parallel lengths, the grooves each having a depth direction extending perpendicular to the length of the groove, the depth direction of one of the grooves being oriented substantially perpendicular to the depth direction of the other of the grooves such that a face panel having an end edge inserted into one of the grooves is oriented perpendicular to a face panel having and end edge inserted into the other of the grooves;

a fascia panel for positioning adjacent to one of the opposite surfaces of the face panel, the fascia support portion of the at least one lateral member of the base frame being laterally spaced from the base rail of the base frame for supporting the fascia panel at a position laterally outward from the face panel when the face panel is mounted on the base rail, the fascia panel having a recess for receiving the fascia support portion of the at least one lateral member such that the fascia panel is held in a position adjacent to the one surface of the face panel when the face panel is mounted on the base rail;

a cap assembly for capping a modular interlock wall form, the cap assembly comprising:

a cap panel being elongate and having opposite ends, the cap panel having a pair of laterally spaced parallel grooves extending between the ends of the cap panel for receiving the tongue of the second edge of a pair of laterally spaced face panels, the cap panel having an aperture therethrough between the grooves;

an anchor having an L-shaped portion and a hook portion, the L-shaped portion being adapted for embedding in one of the opposite surfaces of the face panel with the hook portion extending upward from the surface between spaced face panels of the modular interlocking wall; and a cap panel securing rod having a hook portion and a substantially straight portion, the hook portion being adapted for linking with the hook portion of the anchor, the substantially straight portion being adapted for passing through the aperture in the cap panel, the cap panel securing rod having a threaded end portion for extending through the aperture such that a nut may be threaded onto the securing rod for pulling the cap panel toward the surface in which the anchor is embedded;

a supplemental linking frame for linking spaced tiers of face panels together at an upper portion of an modular interlocking wall below a cap panel, the supplemental linking frame being elongate and having opposite ends, the linking frame being adapted for positioning in an end-to-end orientation with other base frames, the supplemental linking frame comprising:

a pair of elongate longitudinal linking members extending in the longitudinal direction of the linking frame, the linking members being laterally spaced; and a plurality of spanning members extending laterally across the linking members, the spanning members being substantially uniformly longitudinally spaced along the length of the linking members of the linking frame, each of the spanning members having opposite ends, the linking members being coupled to each of the spanning members at laterally spaced locations on the spanning member, the spanning members each being generally elongate with opposite end portions and a central portion, the end portions being substantially U-shaped with an end oriented perpendicular to the central portion for being inserted into pockets formed in the groove of the second edge of the face panel, the central portion having a pair of arcuate semicircular portions linked by a substantially straight portion, the linking member being mounted on one of the arcuate semicircular portions of the spanning member;

wherein the second edge of the face panel has a lateral slot oriented substantially perpendicular to the groove in the second edge, the lateral slot being adapted to receive a portion of the length of one of the spanning members; and wherein the kit includes a plurality of face panels, at least one of the plurality of face panels having a first length and at least one of the plurality of face panels having a second length, the second length being approximately twice the first length.

* * * * *